US007431288B2

(12) United States Patent
Shmaiser et al.

(10) Patent No.: US 7,431,288 B2
(45) Date of Patent: Oct. 7, 2008

(54) PRINT MEDIA FLIPPING MECHANISM AND METHOD

(75) Inventors: Aron Shmaiser, Rishon Iezion (IL); Yosef Rosen, Sitriya (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 436 days.

(21) Appl. No.: 11/137,029

(22) Filed: May 25, 2005

(65) Prior Publication Data

US 2005/0271448 A1 Dec. 8, 2005

Related U.S. Application Data

(63) Continuation-in-part of application No. PCT/IL03/00403, filed on May 15, 2003, which is a continuation-in-part of application No. PCT/IL03/00086, filed on Feb. 3, 2003.

(51) Int. Cl.
*B65H 29/00* (2006.01)

(52) U.S. Cl. ..... 271/186; 271/207; 271/211; 271/213; 271/220; 271/314; 271/196

(58) Field of Classification Search ..... 271/309, 271/185, 186, 314, 207, 211, 213, 220, 196
See application file for complete search history.

(56) References Cited

U.S. PATENT DOCUMENTS

| | | | | |
|---|---|---|---|---|
| 4,310,152 | A * | 1/1982 | Mitzel | 271/186 |
| 4,466,605 | A * | 8/1984 | Leuthold et al. | 271/177 |
| 4,647,032 | A * | 3/1987 | Oba | 271/186 |
| 5,409,202 | A * | 4/1995 | Naramore et al. | 270/58.12 |
| 5,447,303 | A * | 9/1995 | Smith | 271/291 |

* cited by examiner

*Primary Examiner*—David H Bollinger

(57) ABSTRACT

Apparatus for delivering a sheet to a surface, comprising a rotating gripper that receives and grips the sheet at or near a leading edge thereof at a first position and delivers the leading edge to a second position, the first and second positions being situated along a circular path along which the rotating gripper travels; a surface having a stop at the second position; and a blower adapted to blow air at the sheet as it is held by the rotating gripper and after it is released by the gripper at the second position, the blowing of the air being in a direction that urges the sheet away from the circular path. The sheet is not positively held on the circular path except by the leading edge grippers.

26 Claims, 11 Drawing Sheets

PRINT MEDIA FLIPPING MECHANISM AND METHOD

RELATED APPLICATIONS

The present application is a continuation-in-part of PCT application PCT/EL03/00403, filed on May 15, 2003, which is a continuation in part of PCT/IL03/00086 filed Feb. 3, 2003 the disclosures of both of which are incorporated herein by reference.

FIELD OF THE INVENTION

The field of the invention is printers and copiers and particularly mechanisms and methods for flipping substrates on which images are printed.

BACKGROUND OF THE INVENTION

When a printer or copier does two-sided copying, it generally prints one side of the paper first, then flips the paper over and prints the other side. A large number of patents and published patent applications exist for paper-flipping mechanisms, including GB 2 168 688 A to Xerox Corp., U.S. Pat. No. 4,969,641 to Fukushima et al., U.S. Pat. No. 5,201,517 to Stemmle, U.S. Pat. No. 5,692,740 to Holtje, U.S. Pat. No. 5,692,747 to Guerrero et al., U.S. Pat. No. 5,720,478 to Carter et al., U.S. Pat. No. 6,199,858 to Wyer, and PCT publication WO 02/060794 A1 to Hallmark Cards Inc. These mechanisms typically work by moving the paper into an intermediate position, and then moving it back out along a different path, so that its orientation is changed. To prevent the paper from going back along the same path when its motion is reversed, something irreversible is done to it before moving it back. In some publications, the irreversible action is falling or sliding under the influence of gravity. Using gravity to move the paper reduces the need for active mechanisms such as motor-driven rollers or pneumatics, reducing cost and increasing reliability. However, the falling or sliding paper must be guided fairly closely to make sure it ends up in the right place without wrinkling or jamming. This leads to the possibility that the first printed side of the paper will be scratched or smudged as a result of rubbing against a surface that is guiding it.

WO 02/060794 A1 discloses a mechanism for flipping card stock for two-sided printing, in which the surface is never rubbed. The card stock is held rigidly in a frame, and the whole frame is flipped over.

U.S. Pat. No. 6,199,858 to Wyer illustrates the difficulty of designing a flipping mechanism using rollers, that does not allow the paper to rub. The device disclosed in Wyer has the primary purpose of forming a shingled stack of paper, but it also flips the paper when forming the stack. In this device, the paper is fed through a first pair of rollers, and the lead end drops straight down to an intermediate position where it is caught between a second pair of rollers. If the paper were very compliant and with no memory of its curvature, then there would be no need for guide walls, and the paper would drop directly between the second pair of rollers without rubbing against anything. But since paper is not completely compliant and does retain a curl, guide walls are needed to make sure the leading edge of the paper is fed into the gap between the second pair of rollers, and the paper can rub against the guide walls.

Other mechanisms for flipping print media, too numerous to mention, are also known in the art.

SUMMARY OF INVENTION

An aspect of some embodiments of the invention concerns a mechanism which flips a sheet of paper (or other media, herein referred to as "paper") over without allowing it to rub against any surface.

In an embodiment of the invention, a gripper grips the leading edge of the sheet and transports it along a circular path to a second position on a surface at which it is released. A blower blows air at the sheet as it is being transported, and after it reaches the second position, to urge it away from the circular path and general toward the surface.

In an exemplary embodiment of the invention, the sheet is not held against the circular path as it moves toward the second position by any mechanism other than the gripper.

There is thus provided, in accordance with an exemplary embodiment of the invention, an apparatus for delivering a sheet to a surface, comprising:

a rotating gripper that receives and grips the sheet at or near a leading edge thereof at a first position and delivers the leading edge to a second position, the first and second positions being situated along a circular path along which the rotating gripper travels;

a surface having a stop at the second position;

a blower adapted to blow air at the sheet as it is held by the rotating gripper and after it is released by the gripper at the second position, the blowing of the air being in a direction that urges the sheet away from the circular path, wherein the sheet is not positively held on the circular path except by the leading edge grippers.

Optionally, the gripper is a vacuum gripper, optionally situated at the end of an arm that rotates about the center of the circle.

Optionally, the blower blows air continuously.

In an embodiment of the invention, the stop includes a second gripper that holds the leasing edge at the second position after its release by the rotating griper. Optionally, the second gripper includes a vacuum nipple that holds the paper.

In an embodiment of the invention, the surface is substantially tangent to the circular path at said second position.

Optionally, the surface is substantially horizontal.

Optionally, stop is a conditional stop that can be opened or closed.

In an embodiment of the invention, the surface is the surface of a belt. Optionally, after the sheet comes to rest on the belt, the belt is operative to remove the sheet from the second position. Optionally, the belt can be selectively driven in either direction so that it can selectively transport the sheet in, either one of two opposite directions.

Optionally, when driven in one direction the belt delivers the printing media in a flipped orientation to be printed on the side opposite a side that was previously printed on. Optionally, when driven in a direction opposite to the one direction the belt delivers the printing media in a flipped orientation to an exit stacker.

In an embodiment of the invention, the surface is the surface of a stacker or the surface of previous sheets stacked in the stacker.

There is further provided, in accordance with an embodiment of the invention, a method of delivering a sheet to a surface, comprising:

gripping at or near a leading edge of the sheet at a first position and delivering the leading edge to a second position by releasing it thereat, said first and second positions being situated along a circular path;

stopping motion of the leading edge by abutting the leading edge against a stop at the second position;

blowing air at the sheet during at least part of the time of travel between the first and second positions and after as it is released at the second position, the blowing of the air being in a direction that urges the sheet away from the path of travel of the leading edge, wherein the sheet is not positively held during travel between the first and second positions except by gripping at or near said leading edge.

Optionally, the path of the leading edge between said first and second positions is a generally circular path.

Optionally, the sheet is held at or near said leading edge during travel from said first to said second position by at least one vacuum gripper.

Optionally, the blowing of air is continuous.

Optionally, the method includes gripping the sheet at the second position after it is released thereat.

Optionally, a surface onto which the sheet is released at the second position is substantially horizontal.

In an embodiment of the invention, the method includes utilizing a belt to remove the sheet from the second position.

Optionally, the method includes selectively driving the belt in either direction so that it can selectively transport the sheet in either one of two opposite directions. Optionally, when driven in one direction the belt delivers the printing media in a flipped orientation to be printed on the side opposite a side that was previously printed on. Optionally, when driven in a direction opposite to the one direction the belt delivers the printing media in a flipped orientation to an exit stacker.

Optionally, the sheet is stacked on previously delivered sheets at said second position.

DETAILED DESCRIPTION OF EXEMPLARY EMBODIMENTS

Figure 1:
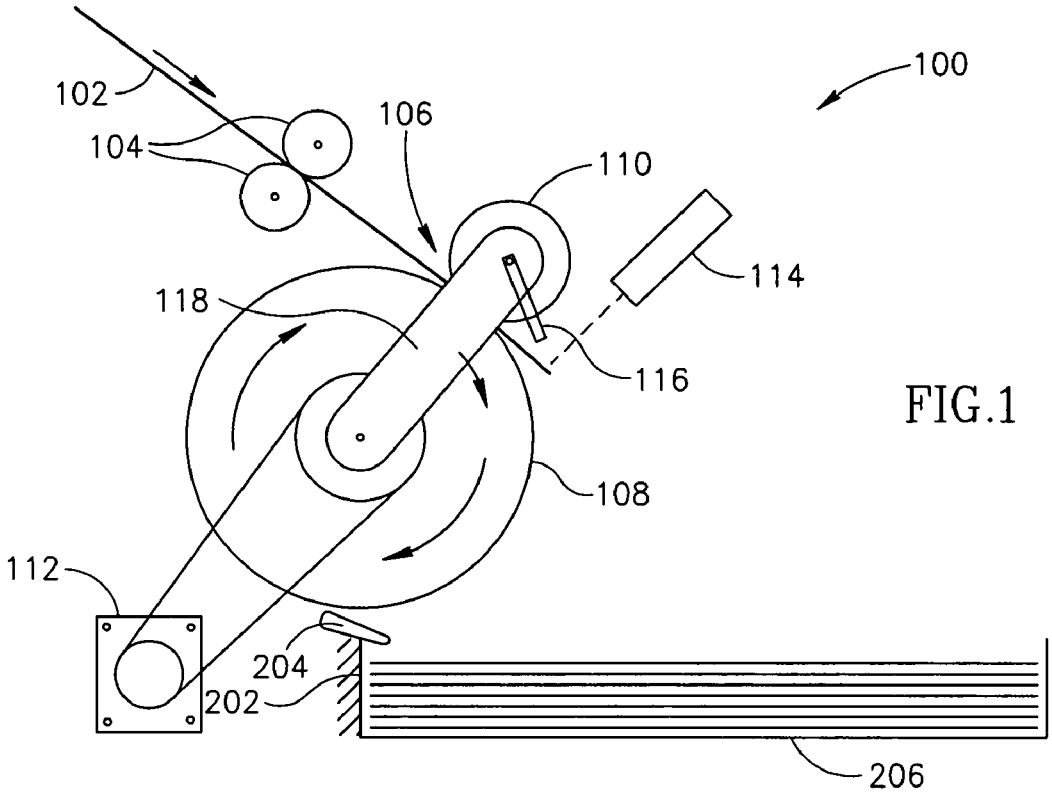
FIGS. 1 through 5 are schematic cross-sectional views of an exemplary embodiment of the invention, showing a time sequence of five stages in flipping a piece of paper or other printing media.

FIG. 1 is a cross-sectional view of a paper flipping mechanism 100, according to an exemplary embodiment of the invention. A piece of paper 102, or other printing media, goes through a pair of feeder rollers 104, which direct the paper so that its leading edge enters a nip 106 between a drive roller 108 and a pinch roller 110. Drive roller 108 is driven in a clockwise direction, optionally at a constant speed, by motor 112.

Optionally, one or both of drive roller 108 and pinch roller 110 do not have solid surfaces going all the way across the width of paper 102, but comprise one or more rims, covering only a portion of the width of the paper. As long as there is some overlap between the one or more rims of drive roller 108 and the one or more rims of pinch roller 110, then the drive roller and the pinch roller will form nip 106.

Optionally, feeder rollers 104 are an integral part of flipping mechanism 100. Alternatively, feeder rollers 104 are the output of another mechanism which performs some process before the paper is flipped over, for example printing a first side of the paper. Optionally, at least one of feeder rollers 104 is motor driven, turning at the same surface speed as drive roller 108. Alternatively, feeder rollers 104 are passive, or their speed easily changes in response to any torque exerted on them by paper 102, so their speed adjusts to match the speed of drive roller 108 once paper 102 is taken up by drive roller 108. Alternatively, feeder rollers 104 are motor driven until paper 102 is taken up by drive roller 108, at which time feeder rollers 104 are decoupled from the motor driving them and then move passively at the speed that paper 102 is moving. In some embodiments of the invention, there are no feeder rollers 104, and there is another mechanism for feeding the paper into flipping mechanism 100, for example, a pneumatic mechanism.

To avoid damaging a printed image on one side of the paper, feeder rollers 104, or an alternative mechanism, are optionally positioned close enough to nip 106, and at an orientation, such that the leading edge of paper 102 finds nip 106 and is taken up by drive roller 108 and pinch roller 110, without ever rubbing against drive roller 108 or pinch roller 110. Alternatively, paper 102 does not find the exact position of nip 106 every time, but paper 102 is moving at the same speed as the surface of drive roller 108 and pinch roller 110, due to feeder rollers 104, so even if drive roller 108 or pinch roller 110 has to deflect the leading edge of paper 102 to guide it into nip 106, the paper will not rub against drive roller 108 or pinch roller 110.

A sensor 114, located just past nip 106, senses when the lead edge of paper 102 has passed through nip 106. Optionally, there is a leading edge guide 116 attached to pinch roller 110, and sensor 114 is located just past the leading edge guide. Pinch roller 110 is attached to an angular driver 118, which is capable of moving pinch roller 110 back and forth around drive roller 108. Optionally, angular driver 118 is driven by its own motor, not shown in FIG. 1, separate from motor 112. Alternately, angular driver 118 is driven by motor 112, the same motor which drives drive roller 108, but there are gears and/or cams, not shown in FIG. 1, which allow angular driver 118 to disengage from motor 112, or to be driven in reverse by motor 112. Optionally, the gears also allow angular driver to be driven at different speeds, without changing the speed of drive roller 108.

In an exemplary embodiment of the invention, drive roller 108 rotates at a constant speed. When sensor 114 senses that the leading edge of paper 102 has passed nip 106 and/or leading edge guide 116, then sensor 114 sends a signal to a controller, not shown in FIG. 1, which causes angular driver 118 to start rotating at the same angular speed and direction as drive roller 108. Hence, pinch roller 110 and leading edge guide 116 (if leading edge guide 116 exists) stay close to the leading edge of paper 102, as drive roller 108 turns.

Alternatively, drive roller 108 starts to rotate only when the paper approaches the nip between the drive roller and the pinch roller. However, this alternative is less advantageous than having the drive roller rotating continuously, since it requires control of and quick changes in the rotational velocity of the drive roller.

Figure 2:
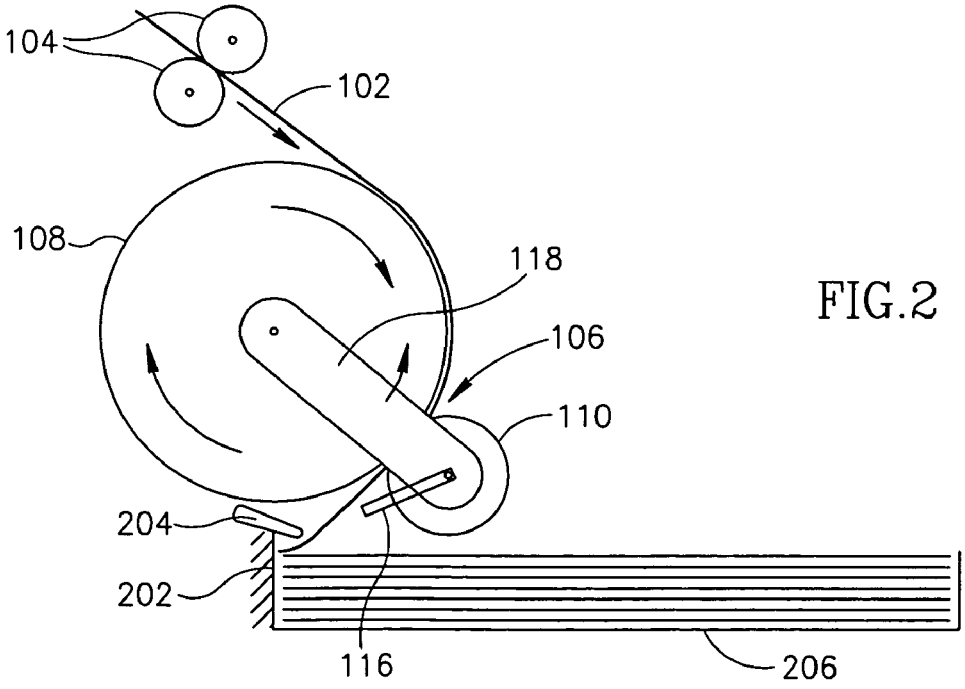

Eventually, as shown in FIG. 2, pinch roller 110 and the leading edge of paper 102 are near the bottom of drive roller 108. When the leading edge of paper 102 reaches a stop 202, optionally guided into the narrow space beneath drive roller 108 by leading edge guide 116, then the leading edge of paper 102 cannot go any further. At this time, an optional leading edge clamp 204 pushes paper 102 down, holding paper 102 at a point close to its leading edge, pulling paper 102 away from contact with drive roller 108, at least in the region between pinch roller 110 and the leading edge of paper 102. Leading edge clamp 204 holds this leading portion of paper 102 down against the bottom of an output tray 206, or against the top paper in a stack of papers that are already resting in output tray 206. This prevents paper 102 from rubbing against drive roller 108. Alternatively, there is no leading edge clamp 204, and the leading portion of paper 102 simply falls away from drive roller 108, once the leading edge of paper 102 reaches stop 202. Having the leading portion of paper 102 fall away from drive roller 108 is optionally facilitated if, as explained below, pinch roller 110 starts to move back up drive roller 108 even before the leading edge of paper 102 has quite reached stop 202, but when the leading edge of paper 102 is close enough to stop 202 that pinch roller 110 and optionally leading edge guide 116 are no longer needed to guide the leading edge of paper 102 toward stop 202.

Figure 3:
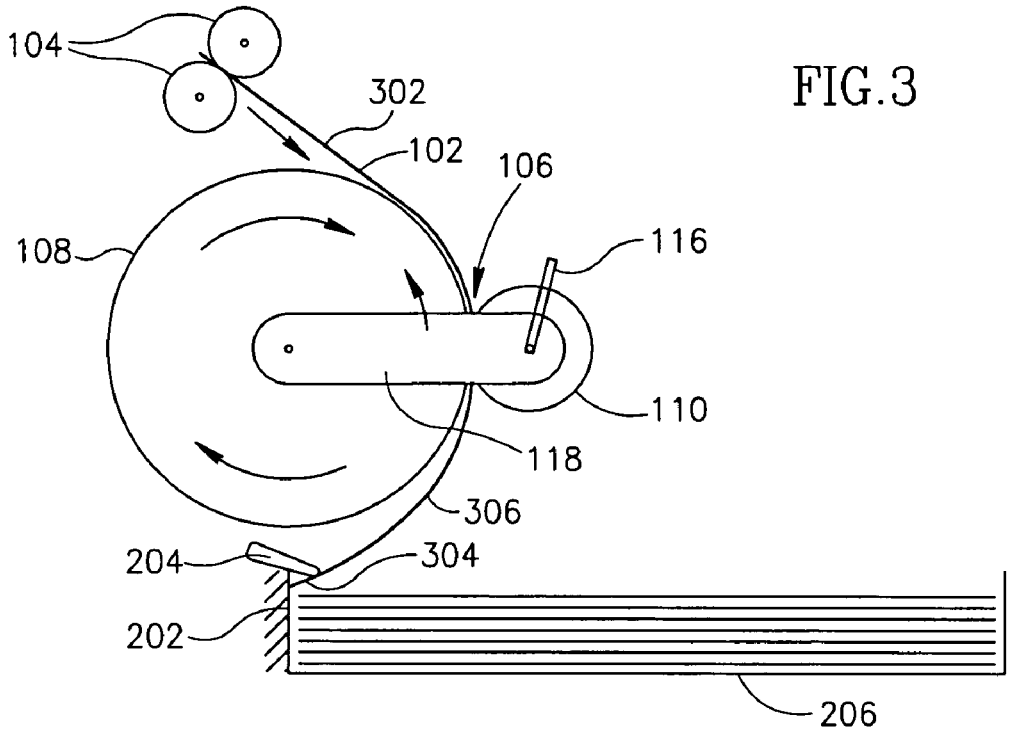

At the same time as the leading edge of paper 102 reaches stop 202, or optionally slightly before as discussed above, angular driver 118 reverses direction, bringing pinch roller 110 back up drive roller 108, as shown in FIG. 3. The motion of the pinch roller is preferably a rolling motion along paper 102 so that there is no rubbing of the paper on the pinch roller. Optionally, angular driver 118 goes back up drive roller 108 at a different angular speed than drive roller 108, for example it goes at a faster angular speed than drive roller 108. A trailing portion 302 of the paper, up to pinch roller 110, continues to move at the speed of drive roller 108, while a leading portion 304, between clamp 204 and the leading edge, is not moving. As a result, a middle portion 306 of the paper begins to buckle, separating from drive roller 108 between pinch roller 110 and clamp 204.

At first, shortly after the leading edge has stopped moving, middle portion 306 is very short, and cannot buckle very much without creasing. At this time, however, the paper has only been buckling for a short time, so the degree of buckling is small, and can be accommodated within the short distance of middle portion 306 without bending too sharply and creasing. As the paper continues to buckle, it needs a greater length to accommodate the buckling, but a greater length is available in middle portion 306 because pinch roller 110 is moving away from the leading edge. Depending on the characteristics of the paper, creasing can be avoided if pinch roller 110 is moving back up drive roller 108 faster than some minimum speed, for example at least as fast as drive roller 108 is turning.

Figure 4:
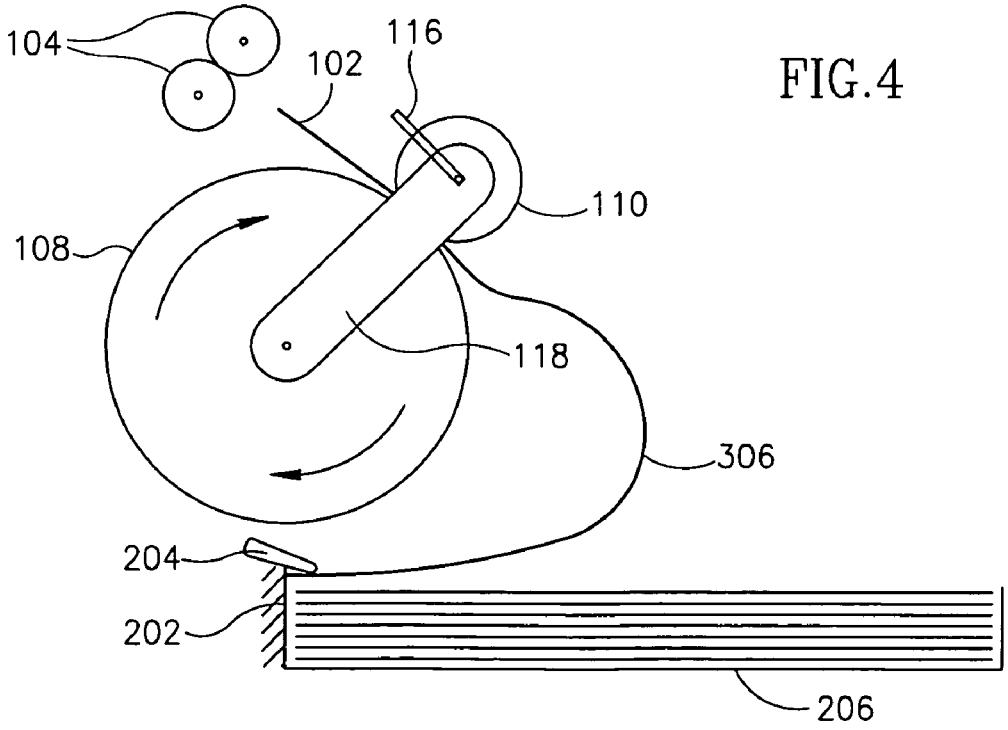

Optionally, leading edge guide 116, if it exists, moves back out of the way as pinch roller 110 moves back up drive roller 108, as seen in FIG. 3 and FIG. 4. In this way, leading edge guide 116 does not rub against the back of the paper as it buckles and moves further away from drive roller 108. For example, the angular guide rotates counterclockwise around the axis of pinch roller 110, so that it clears the stack of papers.

Alternatively, leading edge guide 116 is fixed in position relative to angular driver 118, at a position such that it effectively guides the leading edge of paper 102 to stop 202, but does not rub against middle portion 306 of the paper as it buckles.

Figure 5:
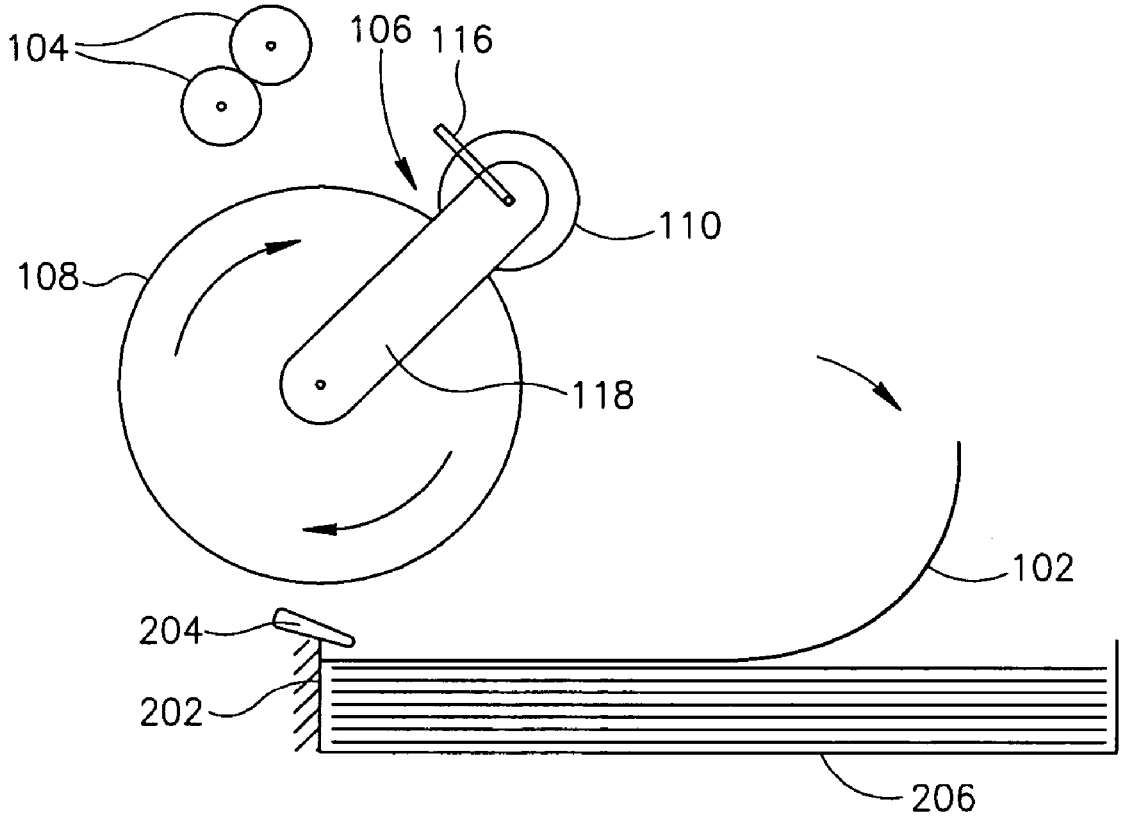

When the trailing edge of paper 102 goes through nip 106 and is free of drive roller 108, the trailing portion of the paper falls down, as shown in FIG. 5. Optionally, instead of the trailing portion of the paper falling under the influence of gravity, it is forced downward by other means, for example by moving air. If gravity is not used, then the direction shown as down in the drawings need not be directly down. It should be understood that references herein to the paper falling may also refer to these other means of moving the paper.

Because the leading portion of the paper is resting against stop 202, there is no need to guide the paper into a correct position as it falls, so there is nothing for the trailing portion of the paper to rub against as it falls. If leading edge clamp 204 exists and is holding down the leading portion of paper 102, this prevents the leading edge of paper 102 from drifting even slightly away from stop 202 as it falls. After falling, the paper lies in output tray 206 in a flipped over orientation, relative to its orientation before feeding into the flipping mechanism. From output tray 206, paper 102 is optionally moved to a place where it is further processed, for example the other side of the paper is printed. Optionally, a plurality of papers are stacked in the output tray, with the bottom of the output tray moving down to accommodate the stack, before any papers are moved out of the output tray. Alternatively, flipping the paper is the last process done to the paper, and paper 102, or a stack of flipped papers, remains in the output tray.

FIGS. 6, 7, 8 and 9 show a time sequence, corresponding to FIGS. 1, 2, 3 and 4, according to another exemplary embodiment of the invention. This embodiment of the invention differs from the embodiment described above, because pinch roller 110 may be fixed in position near the top of drive roller 108, and there is no angular driver 118 which moves pinch roller 110 around drive roller 108. Pinch driver 110 is, of course, free to rotate on its axis. Instead of using pinch roller 110 to hold the leading portion of paper 102 against drive roller 108 as drive roller 108 turns, there is a holder for the leading edge of paper 102, such as a suction system 616 inside drive roller 108, which holds the leading portion of paper 102 against drive roller 108.

Optionally, as in the embodiment shown in FIGS. 1-4, drive roller 108 does not have a solid surface going all the way across the width of the paper, but has one or more rims which go across only a portion of the width of paper 102, and has one or more arms with suction cups, located, for example, to the side of the one or more rims, which hold the leading edge of paper 102, playing the same role as suction system 616.

In one embodiment of the invention, drive roller 108 rotates continuously and the feeding of the paper is synchronized with the arrival of the suction system at nip 106, between drive roller 108 and pinch roller 110.

Figure 6:
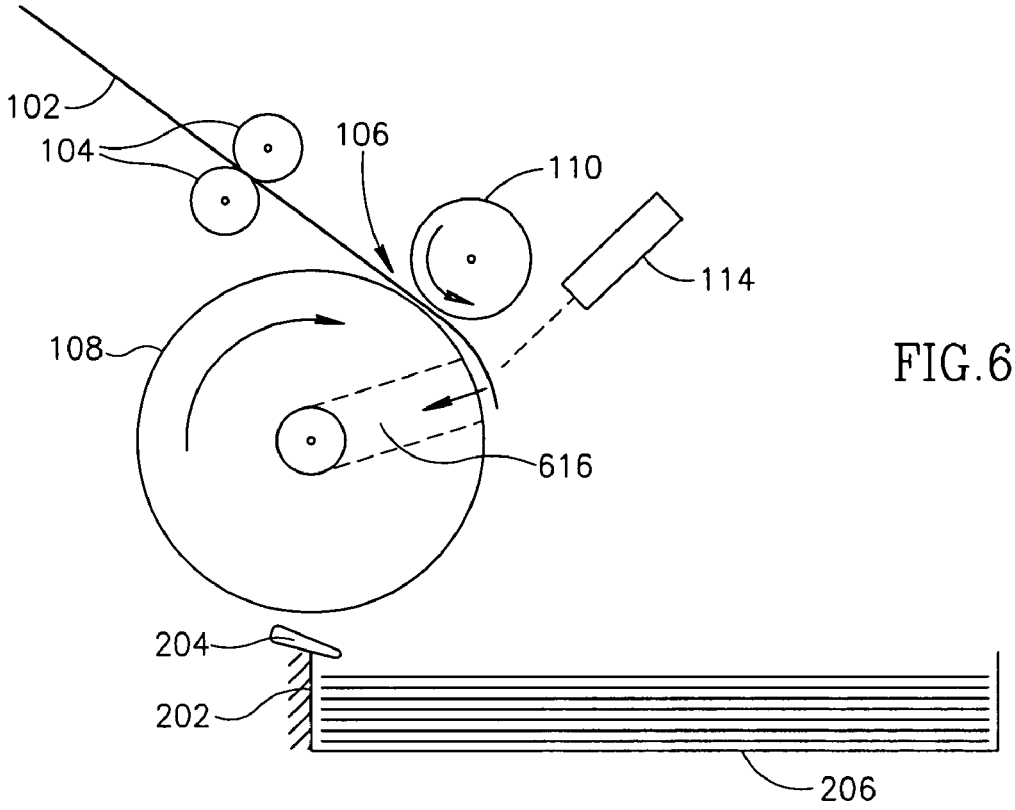
FIGS. 6 through 9 are schematic cross-sectional views of another exemplary embodiment of the invention, showing a time sequence of four stages in flipping a piece of paper or other printing media, corresponding respectively to FIGS. 1, 2, 3 and 4 in that embodiment of the invention.

In some embodiments of the invention, suction system 616 is activated when sensor 114 detects the leading edge of the paper passing through nip 106. Alternatively, suction system 616 is active even before the leading edge of paper 102 is picked up by nip 106, or suction system 616 is turned on at a time when the leading edge of paper 102 is expected to go past nip 106. In these cases, optionally there is no need for sensor 114. Although FIG. 6 shows an opening in suction system 616 only at one azimuthal position at the surface of drive roller 108, optionally there are openings at the surface of drive roller 108 to provide suction at more than one azimuthal position around drive roller 108, since the leading edge of paper 102 optionally does not always contact drive roller 108 at the same azimuthal position. Just before the leading edge of paper 102 reaches stop 202, suction system 616 releases paper 102, and the leading portion of paper 102 falls away from drive roller 108, preventing paper 102 from rubbing against drive roller 108 after the leading edge of paper 102 comes to rest against stop 202.

Alternatively, instead of or in addition to suction system 616, there are grippers, not shown in the drawings, which hold the leading portion of paper 102 against drive roller 108. However, using a suction system instead of grippers has the advantage that it is not necessary to get the grippers out of the way of stop 202 as drive roller 108 continues to turn after the leading portion of paper 102 is released.

Figure 7:
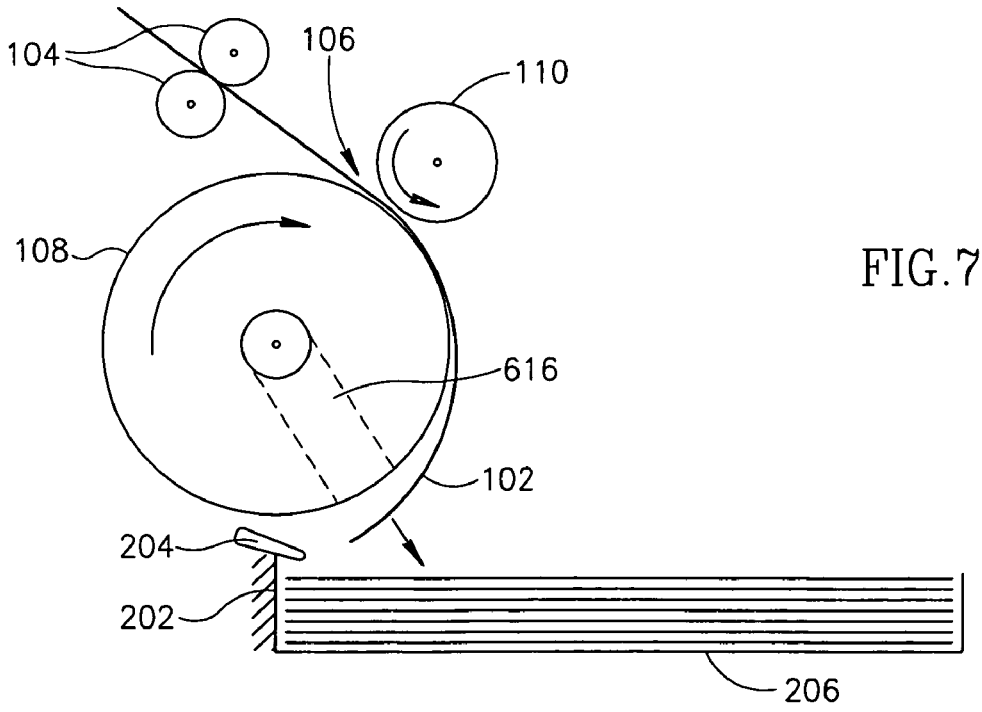
Figure 8:
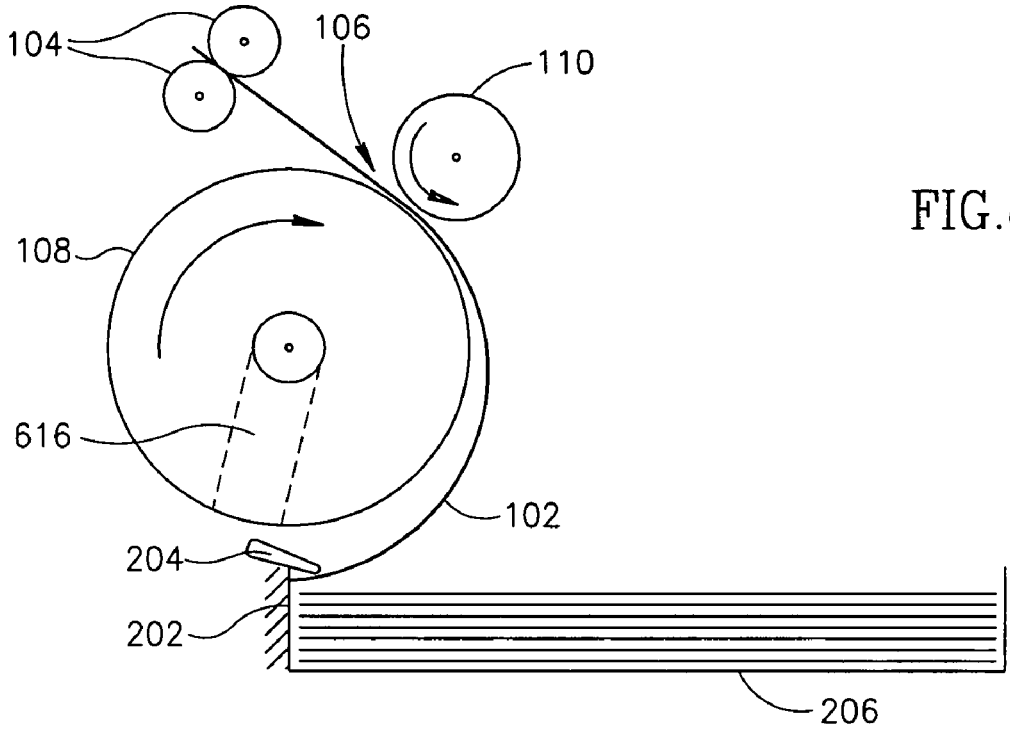
Figure 9:
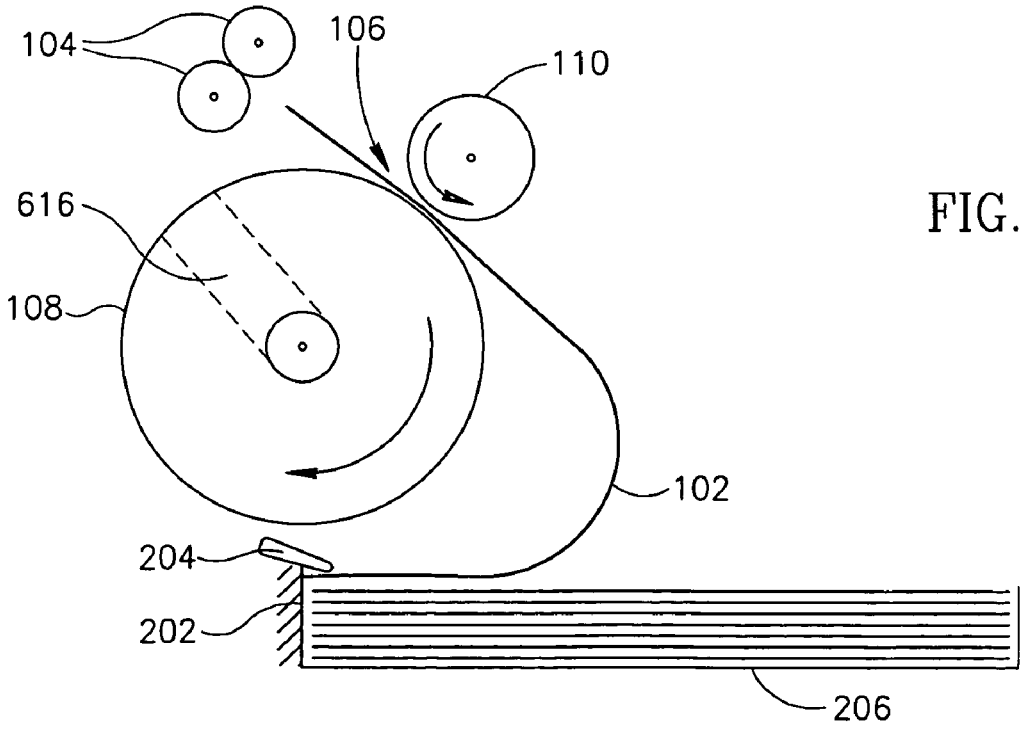

FIG. 7 shows the leading edge of paper 102 being released by suction system 616 from drive roller 108 as the leading edge of paper 102 reaches stop 202. FIG. 8 shows paper 102 beginning to buckle as drive roller 108 continues to turn, and FIG. 9 shows the paper buckling further as drive roller 108 continues to turn. The last step of the time sequence looks the same as FIG. 5, but without leading edge guide 116 or angular driver 118, showing the trailing edge of the paper released from nip 106, and the paper falling down.

Figure 10A:
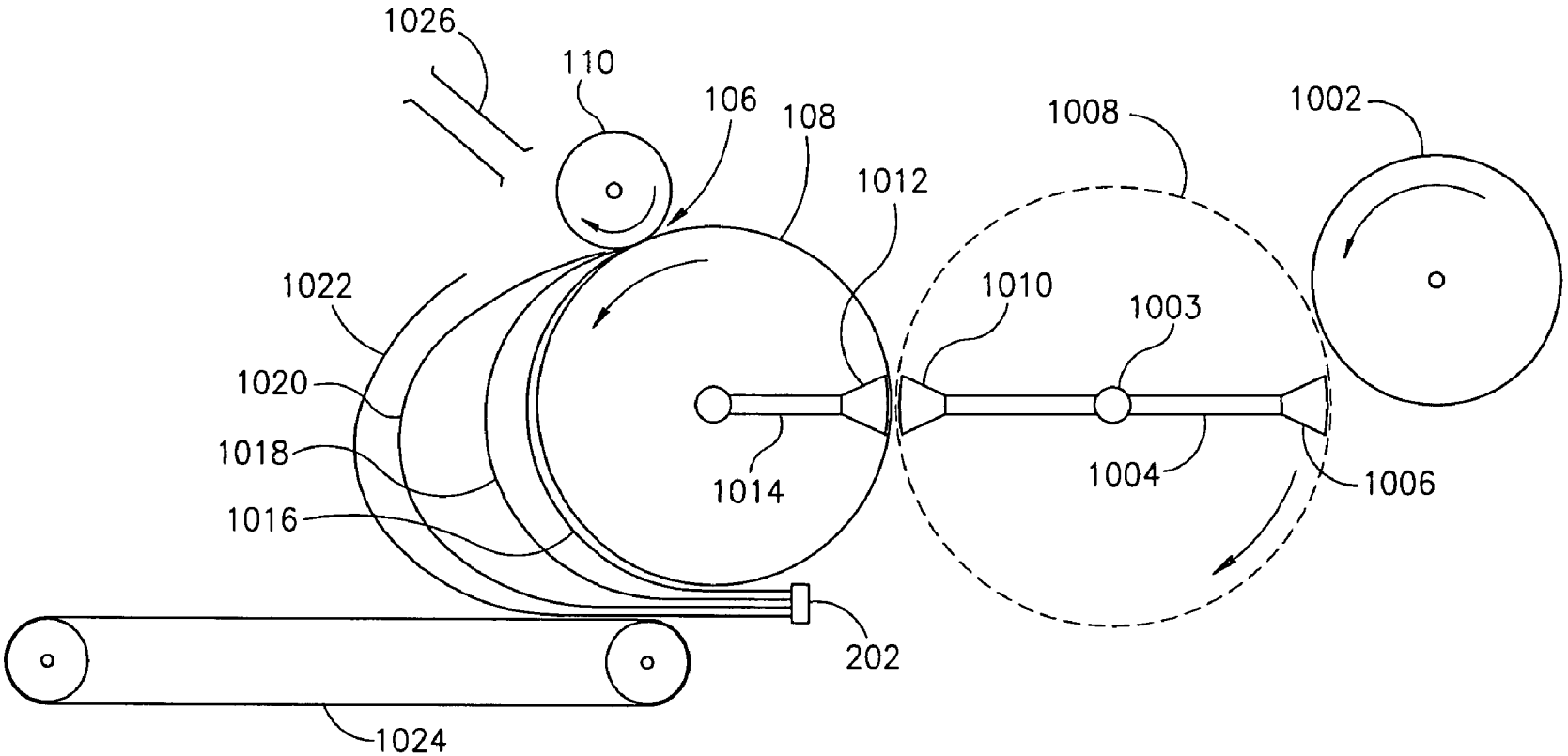
FIG. 10A is a schematic cross-sectional view of an exemplary embodiment of the invention, with a bypass mechanism disabled.
Figure 10B:
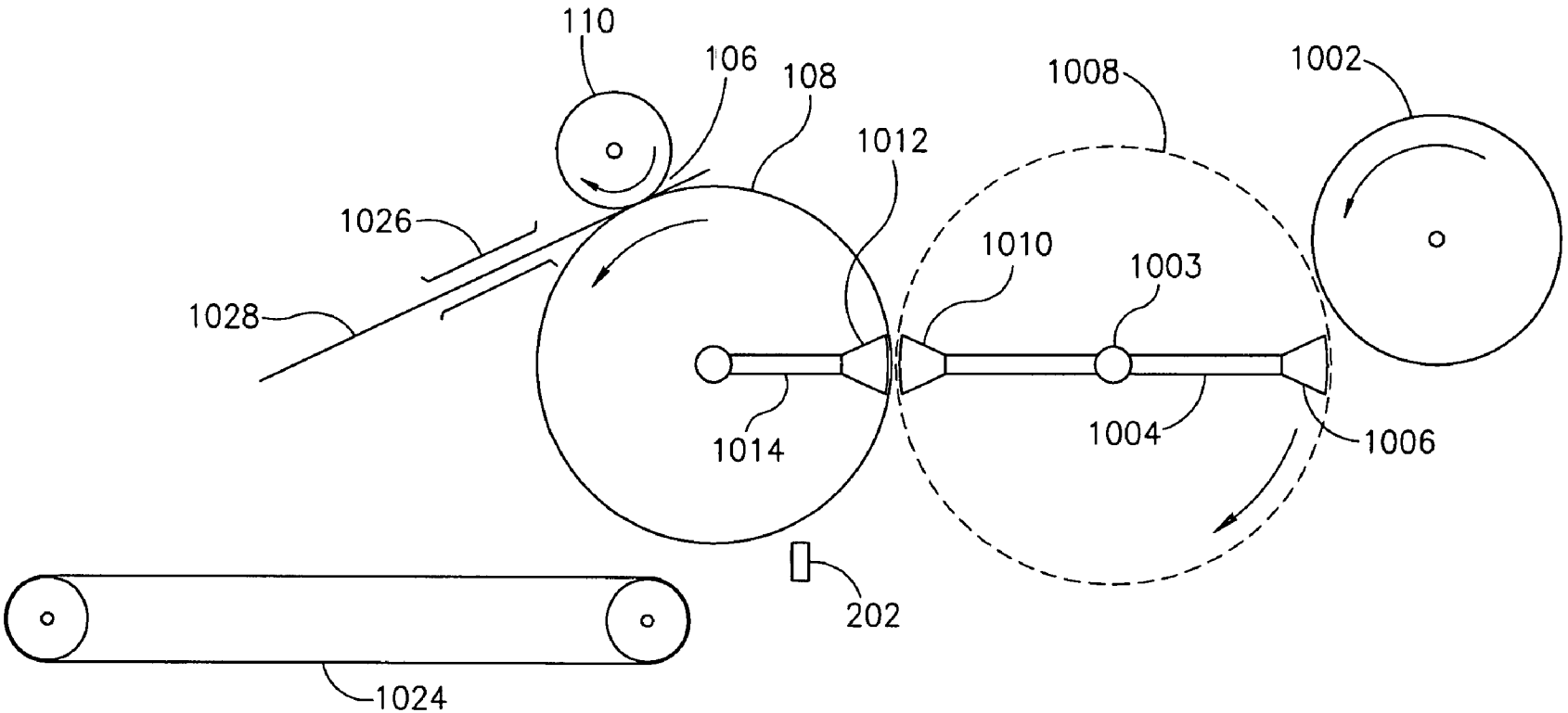
FIG. 10B shows the same embodiment with the bypass mechanism activated.
Figure 11:
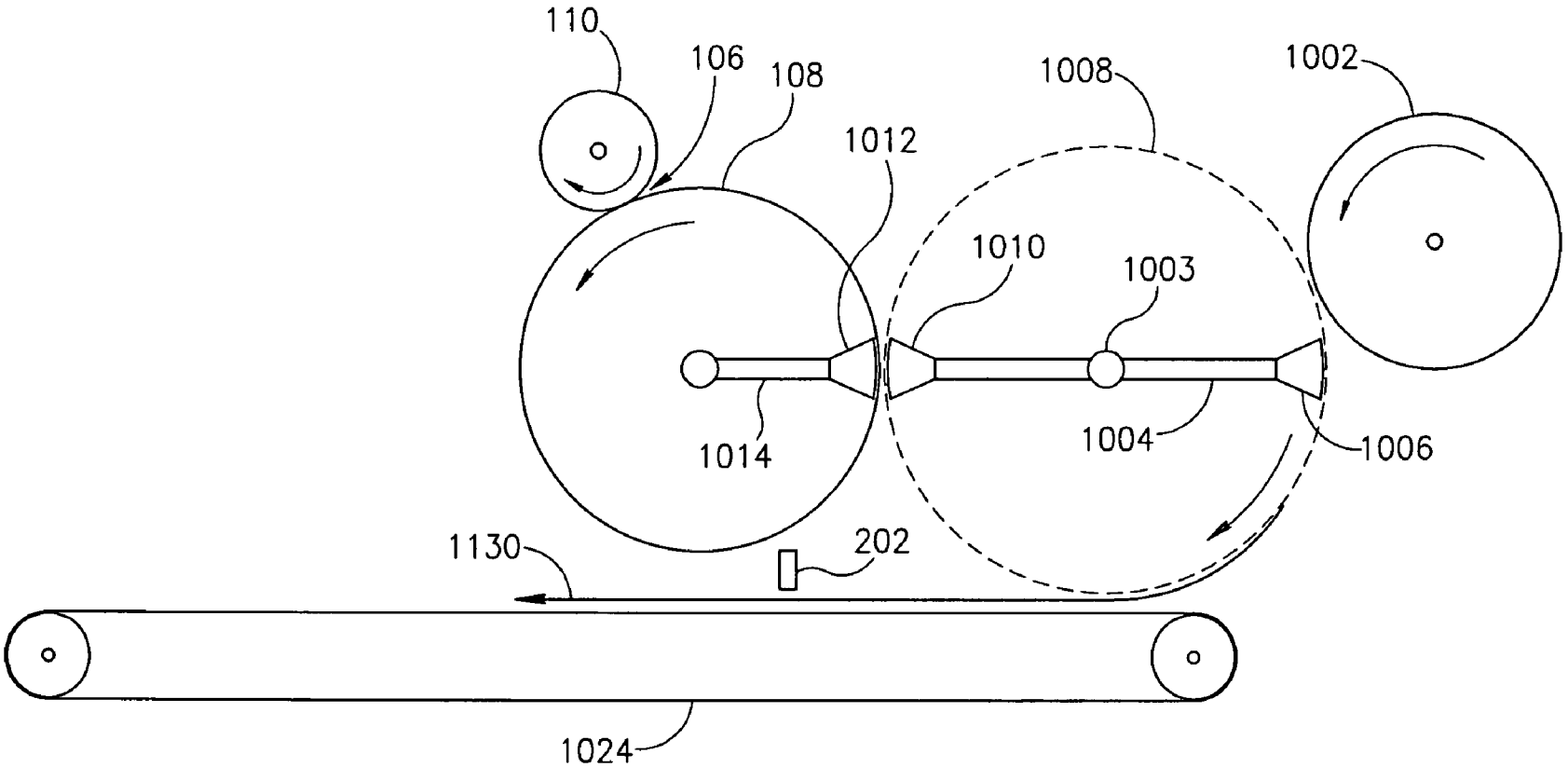
FIGS. 11-13 are schematic cross-sectional views of different exemplary embodiments of the invention with bypass mechanisms.
Figure 12:
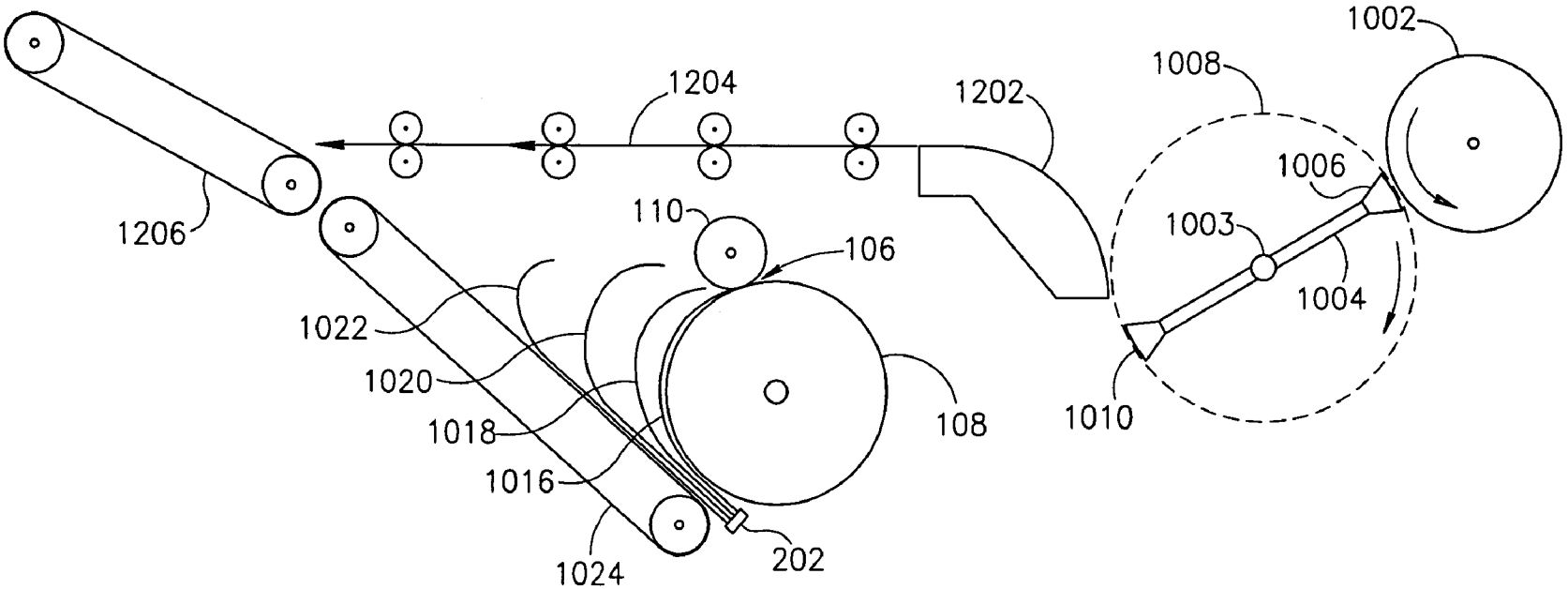
Figure 13:
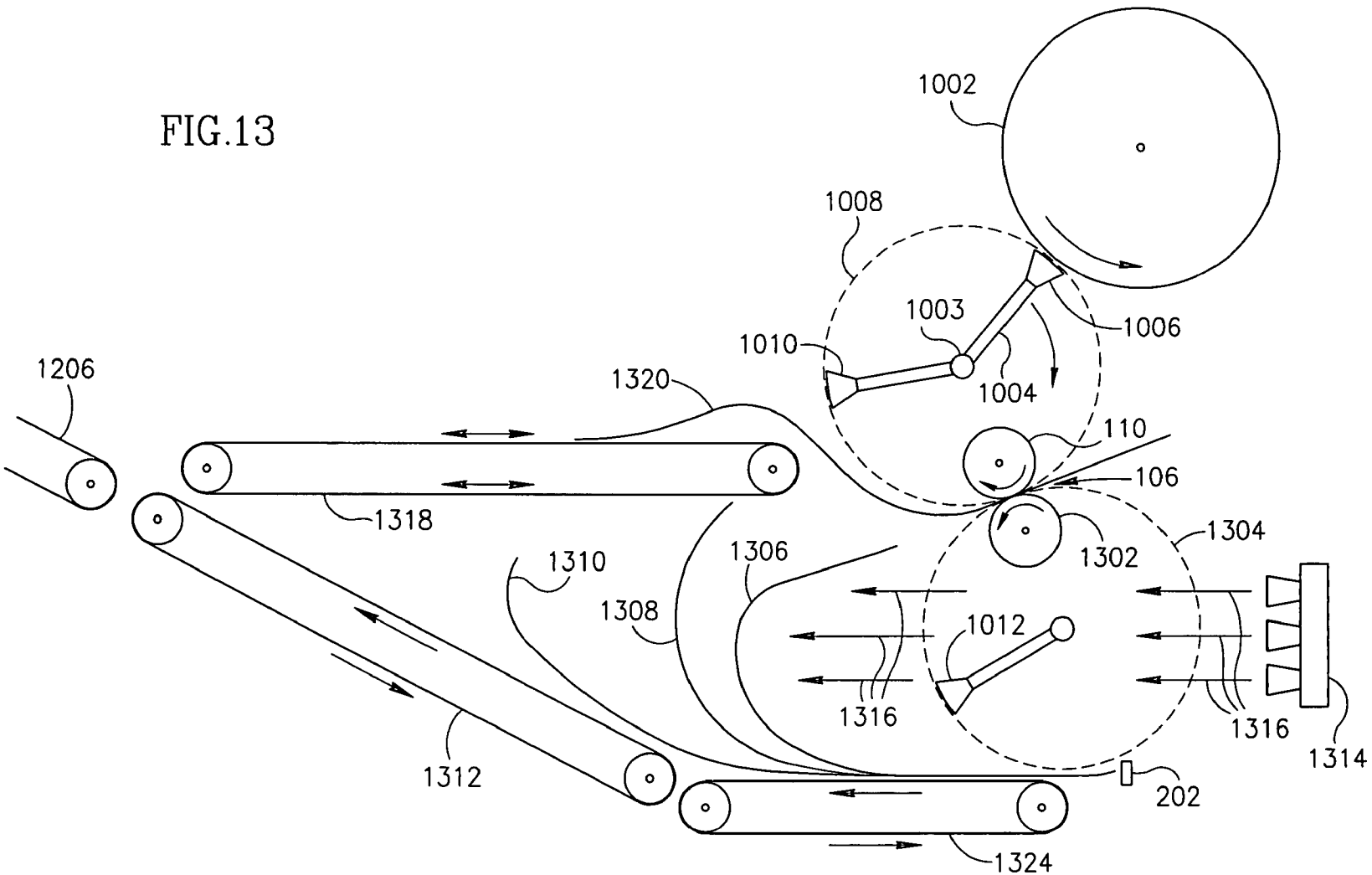

FIGS. 10A, 10B, 11, 12, and 13 show embodiments of the invention in which there is a bypass mechanism, which allows the paper to bypass the paper flipping mechanism. FIGS. 10A and 10B show one such embodiment, with the bypass mechanism disabled in FIG. 10A, and operating in FIG. 10B. FIGS. 11, 12, and 13 show other embodiments with alternative bypass mechanisms.

In FIG. 10A, an image is printed on the printing media at impression cylinder 1002. A transfer rotor 1003 has an arm 1004 with a suction cup 1006 at one end, which picks up the printing media from impression cylinder 1002 after the image is printed. Suction cup 1006 follows a circular path 1008, carrying the printing media to drive roller 108. FIG. 10A shows arm 1004 extending also to the other side of rotor 1003, and another suction cup 1010 on the other end of arm 1004. Optionally, this allows one suction cup to bring one sheet of printing media to drive roller 108, while the other suction cup is picking up the next sheet of printing media from impression cylinder 1002. Alternatively, there is only one suction cup associated with transfer rotor 1003, or there are three or more suction cups associated with transfer rotor 1003. If there are two or more suction cups, they need not be in the same plane, parallel to the plane of the drawing. Optionally, each suction cup shown in FIG. 10A represents a plurality of suction cups, optionally each attached to its own arm, and arranged one behind the other, which attach to different locations across the width of the paper, as is known in the art.

Optionally, drive roller 108 does not have a solid surface across the entire width of the printing media, but has at least one solid rim, and there is a suction cup 1012, mounted on an arm 1014. Optionally, there are at least two rims, and arm 1014 and suction cup 1012 are located between two of the rims. Alternatively, whether or not there are at least two rims, arm 1014 and suction cup 1012 are located behind or in front of one of the at least one rims. Alternatively, drive roller 108 does have a solid surface across the entire width of the paper, and suction cup 1012 in FIG. 10A represents the opening of a suction system inside drive roller 108.

Suction cup 1012 picks up the printing media from suction cup 1010 (or from suction cup 1006 if suction cup 1006 is adjacent to drive roller 108 at the time). Suction cup 1012 then conveys the leading edge of the printing media so that it enters a nip 106 between drive roller 108 and a pinch roller 110. Optionally, pinch roller 110, like drive roller 108, does not have a solid surface all the way across the width of the printing media, but has one or more solid rims. If neither drive roller 108 nor pinch roller 110 have solid surfaces across their entire widths, then there is at least one region across the width of the printing media where drive roller 108 and pinch roller 110 both have rims, in order to form nip 106 between them.

The flipping mechanism in FIG. 10A works in the same way as the flipping mechanism described in FIGS. 6-9, with suction cup 1012 in FIG. 10A playing the role of suction system 616 in FIGS. 6-9. Suction cup 1012 carries the leading edge of the printing media down and around as drive roller 108 rotates. When the leading edge of the paper reaches leading edge stop 202, it is released from suction cup 1012, because the vacuum in suction cup 1012 is reduced, and/or because leading edge stop 202 prevents the leading edge from continuing around drive roller 108 with-suction cup 1012. A trailing portion of the printing media continues to move through nip 106, driven by drive roller 108. As a result, the printing media buckles, and moves out from drive roller 108. The position of the printing media at successive times, after the leading edge reaches leading edge stop 202, is shown by curves 1016, 1018, 1020 and 1022. When the trailing edge of the printing media passes through nip 106, the printing media falls down to a transport belt 1024, in a flipped over orientation, and is carried away from drive roller 108.

Optionally, instead of transport belt 1024, the printing media falls to a fixed location, similar to output tray 206 in FIGS. 6-9, for example. Optionally, there is a leading edge clamp, not shown in FIG. 10A, similar to leading edge clamp 204 in FIGS. 6-9, which holds the leading edge of the printing media in place at leading edge stop 202. In this case, if the printing media is transported away on transport belt 1024 after being flipped, then the leading edge clamp releases the leading edge of the printing media so that transport belt 1024 can transport the printing media away. Alternatively, the printing media is held against transport belt 1024 with sufficient strength, for example by a vacuum system or by another pinch roller, so as to pull the printing media out of the leading edge clamp. Optionally, instead of suction cup 1012 holding the leading edge of the printing media to drive roller 108 as it continues past nip 106, pinch roller 110 moves around drive roller 108 and holds the leading edge of the printing media against drive roller 108, as in FIGS. 1-4.

FIG. 10A also shows a bypass mechanism 1026 which is inactivated, raised up and out of the way of the leading edge of the printing media as it emerges from nip 106. In FIG. 10B, bypass mechanism 1026 is activated by lowering it to a position such that the leading edge of the printing media enters bypass mechanism 1026, instead of continuing to travel around drive roller 108, after emerging from nip 106. Optionally, the entrance of the leading edge into bypass mechanism 1026 is assisted by having suction cup 1012 release the leading edge after it passes nip 106. Additionally or alternatively, bypass mechanism 1026 has its own vacuum system, which pulls in the leading edge of the printing media. Once the leading edge is drawn into bypass mechanism 1026, the printing media follows path 1028, and lands on transport belt 1024, without flipping over. Optionally, bypass mechanism 1026 has its own drive roller and pinch roller, with a nip between them, which draws the leading edge of the printing media into bypass mechanism 1026, once the leading edge of the printing media is directed to it. Optionally, instead of being a slot as shown in FIGS. 10A and 10B, bypass mechanism 1026 comprises a conveyer belt.

FIG. 11 shows a flipping mechanism similar to that shown in FIGS. 10A and 10B, but with a different method of bypassing the flipping mechanism. In FIG. 11, transport belt 1024 extends under path 1008 of transport rotor 1003. When it is desired to bypass the flipping mechanism, suction cup 1006 or suction cup 1010 (whichever one has picked up the printing media from impression cylinder 1002) releases the printing media onto transport belt 1024, before the printing media reaches suction cup 1012 and drive rotor 108. Then the printing media follows path 1130, and ends up lying on transport belt 1024, without flipping over.

FIG. 12 shows another bypass mechanism, similar to that shown in FIGS. 10A and 10B. Instead of transport rotor 1003 bringing the printing media directly to drive rotor 108, transport rotor 1003 (and suction cup 1006 or suction cup 1010) brings the printing media to a conveyer 1202. From conveyer 1202, the leading edge of the printing media either falls down and is caught in nip 106, if the bypass mechanism is inactive, or continues on path 1204 if the bypass mechanism is active, eventually reaching a conveyer 1206 without flipping over. The flipped over printing media, on conveyer 1024, is also brought to conveyer 1206. Alternatively, conveyers 1024 and 1206 form a single long conveyer, and printing media from path 1204 is brought onto the single long conveyer. A potential advantage of using two separate conveyers 1024 and 1206 is that conveyer 1206 can be swung out of the way, for access to parts of the printer or copier that are underneath it for example, without affecting the flipping mechanism.

The bypass or flipping mechanism in FIG. 12 can be selected either by transferring the front end of the sheet to path 1204, or by diverting it to nip 106. In general, any method of diverting substrates to one or another path can be used, including movement of rollers (for example a downward movement of the first set of rollers in path 1204 will direct the sheet to nip 106), provision of a trap door, where closing the door causes the printing media to follow path 1204, while opening the trap door disables the bypass mechanism, causing the leading edge of the printing media to fall down and be caught by nip 106. Alternatively, the leading edge of the printing media is selectively directed to nip 106 or to path 1204 by a different method, for example pneumatically, or by an element which pushes against the printing media or by a diverting element which may be selectively placed in path 1204, when flipping is desired.

FIG. 13 shows a flipping mechanism with some additional features, together with a different bypass mechanism. As in FIGS. 10A, 10B, 11 and 12, printing media is picked up from impression roller 1002 by suction cup 1006, which is attached to the end arm 1004 and swung around by transfer rotor 1003. Suction cup 1006 swings the printing media around clockwise, on circular path 1008. When the bypass mechanism is not active, suction cup 1006 transfers the printing media to suction cup 1012, which swings the printing media around counter-clockwise on circular path 1304. At about the time suction cup 1012 picks up the printing media from suction cup 1006 or optionally a little earlier, the leading edge of the printing media passes through nip 106 between rollers 110 and 1302. Although it looks as if rollers 110 and 1302 would interfere with the swinging motion of suction cups 1006 and 1012, in fact the suction cups and rollers are not in the same plane, so they do not interfere with each other. Optionally, each of rollers 110 and 1302 shown in FIG. 13 represents two rollers, one in back of the other, and the two side edges of the printing media go through nip 106, while suction cups 1006 and 1012 are located in a plane between the rollers, somewhere in the center of the printing media. Optionally, one or both of cups 1006 and 1012 shown in FIG. 13 represents two or more cups, one behind the other.

When the leading edge of the printing media reaches a stop 202, suction cup 1012 releases the printing media, and the leading edge of the printing media rests against stop 202. However, a trailing portion of the printing media, which is still caught in nip 106, continues moving forward, since one or both of roller 110 and roller 1302 is a drive roller, which continues to push the printing media through nip 106. As a result, the printing media buckles, and has a configuration similar to 1306. When the trailing edge of the printing media goes through nip 106, the printing media falls down to conveyer 1324 in a flipped over orientation, as shown by 1308 and 1310. Blower 1314 optionally blows a jet of air 1316 at the printing media, helping the media to fall down more quickly. Such an air jet may be particularly useful if the printing media is very light weight, and may prevent the printing media from folding over as it falls.

Conveyer belt 1318 optionally can turn in either direction, as desired. When the bypass mechanism is not activated, conveyer belt 1318 turns clockwise, so the lower portion moves to the left. As the printing media falls down, the upper edge may brush against the lower surface of conveyer belt 1318, which helps to unbend the printing medium and make it lie flat. Conveyer belt 1318 may be particularly useful for a heavy weight or stiff printing media, which does not lose its curl easily. Conveyer belt 1318 and air jets 1316 optionally work together to help make the printing media fall down. Alternatively, only one of them is present or only one of them is operative for some grades of printing media.

From conveyer belt 1324, the printing media is transported to a conveyer belt 1312. Alternatively, a portion of the printing media may fall directly onto conveyer belt 1312. Alternatively, there is only one long conveyer belt, instead of belts 1324 and 1312. Optionally, conveyer belt 1324 and/or conveyer belt 1312 does not start moving until the printing media has fallen down completely, in order to prevent the printing media from folding over as it falls. Alternatively, one or both of belts 1324 and 1312 move continuously, particularly if the printing media falls down quickly enough so that folding is not a problem.

If the bypass mechanism is active, then instead of cup 1006 transferring the printing media to cup 1012 near nip 106, cup 1006 continues to hold the printing media, and releases the printing media only at position 1010. Although there appear to be two suction cups 1006 and 1010 going around transfer rotor 1003, the two cups 1006 and 1010 shown in FIG. 13 are intended to show two different positions of the same cup 1006 as it swings the printing media around. Optionally, however, there are two or even more than two suction cups and arms attached to transfer rotor 1003, so that one suction cup can be picking up one printing media while another suction cup is transferring another printing media.

When suction cup 1010 releases the printing media, a leading portion 1320 of it falls onto conveyer belt 1318. Optionally, suction cup 1010 holds the printing medium some distance away from the its leading edge, so that the leading portion flops over and is located directly above belt 1318 even before cup 1010 releases it. Alternatively or additionally, air jets 1316 help to push the printing media onto belt 1318. Alternatively or additionally, belt 1318 extends closer to suction cup 1010 than shown in FIG. 13, for example directly under it, but not in a position that would interfere with suction cup 1010. Alternatively or additionally, a trailing portion of the printing media is still caught in nip 106 between rollers 110 and 1302 when the leading portion is released by suction cup 1010, and one or both of rollers 110 and 1302 is a drive roller, which continues to push the printing media to the left, causing leading portion 1320 to fall onto belt 1318.

When the bypass mechanism is active, belt 1318 moves counter-clockwise, so the top portion of the belt, where the printing media is resting, moves to the left. The printing media, which is not in a flipped over orientation, goes onto belt 1206 when it reaches the end of belt 1318. Printing media on belt 1312, which are in a flipped over orientation, also go onto belt 1206, when they reach the end of belt 1312. Alternatively, belt 1206 is not separate from belt 1312, but belts 1206 and 1312, and optionally belt 1324 as well, are replaced by one long belt, which printing media from belt 1318 falls onto. Dividing the belt into one than one belt, for example into three belts as shown, has the potential advantage of making it easier to gain access to the machine, since belt 1206, for example, can be swung up and out of the way, without affecting the other belts.

Although FIG. 13 shows both a bypass mechanism and new features of the flipping mechanism, including belt 1318 which participates both in the bypass mechanism and in the flipping mechanism, optionally only one or some of these features are present. For example, optionally belt 1318 runs only in one direction, and is used only in the bypass mechanism, or only in the flipping mechanism. Optionally, some of the features of FIG. 13, such as blower 1314, can be utilized in the other embodiments.

Figure 14:
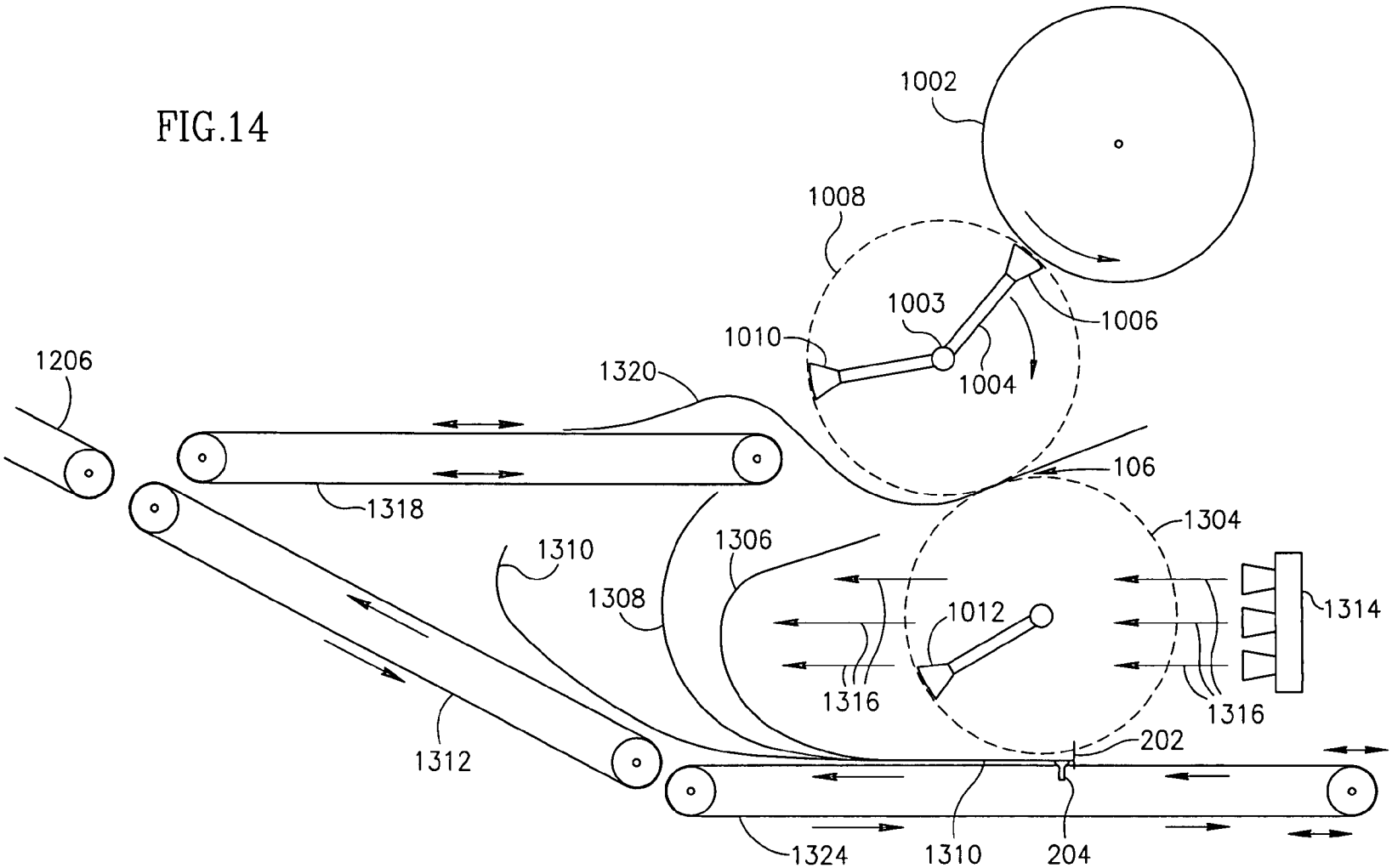
FIG. 14 is a schematic cross-sectional view of another exemplary embodiment of the invention with a bypass mechanism.

FIG. 14 shows an additional exemplary embodiment of the invention. In the embodiment shown in FIG. 14, rollers 110 and 1302 of the embodiment shown in FIG. 13 are removed. Optionally, suction cup 1012 receives the printing media from suction cup 1006. As suction cup 1012 guides the printing media toward stop 202 the trailing portion of the printing media is moved toward the rest position of the sheet by air jets 1316 from blowers 1314 instead of being held up by roller 1302. As shown in FIG. 14 air jets 1316 ensure the flipping of the printing media while suction cup 1012 guides it to stop 202. In general, air jets 1316 need not be synchronized with the movement of the sheet and can be operated continuously.

It is noted that in the embodiment shown in FIG. 14, once the sheet is passed off to suction cup 1012, it is not held by any elements between element 1002 and element 1304 (which is shown as a path, but which may include rings for supporting the sheet or even no support at all). The inventors have found that despite the fact that the sheet is held only by suction cup 1012 until it reaches stop 202, the momentum of the sheet and the air flow provided by air jets 1316 are sufficient to provide for reliable landing of the sheet on belt 1324.

It is also noted that while a suction cup 1012 is shown as holding the sheet while it is delivered to belt 1324, other types of grippers may be used in its place. Furthermore while the sheet is shown as being delivered to the surface of a belt, the present invention can be utilized to deliver sheets to an output stacker.

In some embodiments of the invention, stop 202 is a controlled stop, which can be opened or closed, for example by using a mechanical gate or magnetically controlled gate to optionally stop the advance of the printing media In some embodiments of the invention the printing media is stopped at stop 202. However, after finishing the flipping process, stop 202 is opened to allow the printing media to be transferred to the right on belt 1324. Optionally transferring to the right allows the printing media to be re-fed to the printing mechanism for printing on the other side or to an output stack. Alternatively, belt 1324 can transfer the printing media to the left to be transferred to another printing mechanism or to be delivered out of the printer in the reverse orientation as if delivered by belt 1318 as described above with respect to the previous embodiment. In some embodiments of the invention, belt 1318 is not used.

In some embodiments of the invention, stop 202 is replaced or assisted by a gripper, such as vacuum nipple 204 which receives the printing media from suction cup 1012. Optionally, vacuum nipple 204 couples the printing media to conveyer belt 1324 releasing it from the grasp of suction cup 1012. After coupling the printing media to conveyer belt 1324 it follows the direction of movement of conveyer belt 1324. Vacuum nipple 204 (which may be a suction cup) provides further stability for the sheet from being moved away from the stop by airjets 1316.

Although this description and the claims refer sometimes to paper, the invention may also be used with any other sheet like printing media, such as thin flexible plastic sheets. The invention has been described in the context of the best mode for carrying it out. It should be understood that not all features shown in the drawings or described in the associated text may be present in an actual device, in accordance with some embodiments of the invention. Furthermore, variations on the method and apparatus shown are included within the scope of the invention, which is limited only by the claims. Also, features of one embodiment may be provided in conjunction with features of a different embodiment of the invention. As used herein, the terms "have", "include" and "comprise" or their conjugates mean "including but not limited to."

The invention claimed is:

1. Apparatus for delivering a sheet to a surface, comprising:

a rotating gripper that receives and grips the sheet at or near a leading edge thereof at a first position and delivers the leading edge to a second position, the first and second positions being situated along a circular path along which the rotating gripper travels:

a surface having a stop at the second position:

a blower adapted to blow air at the sheet as it is held by the rotating gripper and after it is released by the gripper at the second position, the blowing of the air being in a direction that urges the sheet away from the circular path, wherein the sheet is not positively held on the circular path except by the rotating gripper wherein the gripper is a vacuum gripper, wherein the gripper is situated at the end of an arm that rotates about a center of the circular path.

2. Apparatus according to claim 1 wherein the blower blows air continuously.

3. Apparatus according to claim 1 wherein the surface is substantially tangent to the circular path at said second position.

4. Apparatus according to claim 1 wherein the surface is substantially horizontal.

5. Apparatus according to claim 1 wherein the surface is the surface of a belt.

6. Apparatus according to claim 5 wherein after the sheet comes to rest on the belt, the belt is operative to remove the sheet from the second position.

7. Apparatus according to claim 6 wherein the belt can be selectively driven in either direction so that it can selectively transport the sheet in either one of two opposite directions.

8. Apparatus according to claim 1 wherein the surface is the surface of a stacker or the surface of previous sheets stacked in the stacker.

9. Apparatus according to claim 1 wherein the stop includes a second gripper that holds the leading edge at the second position after its release by the rotating gripper.

10. Apparatus according to claim 9 wherein the second gripper includes a vacuum nipple that holds the sheet.

11. Apparatus for delivering a sheet to a surface, comprising:

a rotating gripper that receives and grips the sheet at or near a leading edge thereof at a first position and delivers the leading edge to a second position, the first and second positions being situated along a circular path along which the rotating gripper travels:

a surface having a stop at the second position;

a blower adapted to blow air at the sheet as it is held by the rotating gripper and after it is released by the gripper at the second position, the blowing of the air being in a direction that urges the sheet away from the circular path.

wherein the sheet is not positively held on the circular path except by the rotating gripper.

wherein the stop includes a second gripper that holds the leading edge at the second position after its release by the rotating gripper.

12. Apparatus according to claim 11 wherein the second gripper includes a vacuum nipple that holds the sheet.

13. Apparatus according to claim 11 wherein the gripper is a vacuum gripper.

14. Apparatus according to claim 13 wherein the gripper is situated at the end of an arm that rotates about a center of the circular path.

15. Apparatus according to claim 11 wherein the surface is substantially tangent to the circular path at said second position.

16. Apparatus according to claim 11 wherein the surface is substantially horizontal.

17. Apparatus according to claim 11 wherein the surface is the surface of a stacker or the surface of previous sheets stacked in the stacker.

18. Apparatus for delivering a sheet to a surface, comprising:

a rotating gripper that receives and grips the sheet at or near a leading edge thereof at a first position and delivers the leading edge to a second position, the first and second positions being situated along a circular path along which the rotating gripper travels;

a surface having a stop at the second position, a blower adapted to blow air at the sheet as it is held by the rotating gripper and after it is released by the gripper at the second position, the blowing of the air being in a direction that urges the sheet away from the circular path, wherein the sheet is not positively held on the circular path except by the rotating gripper, wherein the stop is a conditional stop that can be opened or closed.

19. Apparatus according to claim 18 wherein the gripper is a vacuum gripper.

20. Apparatus according to claim 19 wherein the gripper is situated at the end of an arm that rotates about a center of the circular path.

21. Apparatus according to claim 18 wherein the stop includes a second gripper that holds the leading edge at the second position after its release by the rotating gripper.

22. Apparatus for delivering a sheet to a surface, comprising:

a rotating gripper that receives and grips the sheet at or near a leading edge thereof at a first position and delivers the leading edge to a second position, the first and second positions being situated along a circular path along which the rotating gripper travels;

a surface having a stop at the second position;

a blower adapted to blow air at the sheet as it is held by the rotating gripper and after it is released by the gripper at the second position, the blowing of the air being in a direction that urges the sheet away from the circular path, wherein the sheet is not positively held on the circular path except by the rotation gripper, wherein the surface is the surface of a belt, wherein after the sheet comes to rest on the belt, the belt is operative to remove the sheet from the second position, wherein the belt can be selectively driven in either direction so that it can selectively transport the sheet in either one of two opposite directions, wherein when driven in one direction the belt delivers the sheet in a flipped orientation to be printed on the side opposite a side that was previously printed on.

23. Apparatus according to claim 22, wherein when driven in a direction opposite to the one direction the belt delivers the sheet in a flipped orientation to an exit stacker.

24. Apparatus according to claim 22 wherein the gripper is a vacuum gripper.

25. Apparatus according to claim 24 wherein the gripper is situated at the end of an arm that rotates about a center of the circular path.

26. Apparatus according to claim 22 wherein the stop includes a second gripper that holds the leading edge at the second position after its release by the rotating gripper.

* * * * *

UNITED STATES PATENT AND TRADEMARK OFFICE

CERTIFICATE OF CORRECTION

PATENT NO. : 7,431,288 B2
APPLICATION NO. : 11/137029
DATED : October 7, 2008
INVENTOR(S) : Aron Shmaiser et al.

It is certified that error appears in the above-identified patent and that said Letters Patent is hereby corrected as shown below:

In column 12, line 22, in Claim 1, delete “travels:” and insert -- travels; --, therefor.

In column 12, line 23, in Claim 1, delete “position:” and insert -- position; --, therefor.

In column 12, line 30, in Claim 1, after “gripper” insert -- , --.

In column 12, line 64, in Claim 11, delete “travels:” and insert -- travels; --, therefor.

In column 13, line 3, in Claim 11, delete “path.” and insert -- path, --, therefor.

In column 13, line 5, in Claim 11, delete “gripper.” and insert -- gripper, --, therefor.

In column 13, line 31, in Claim 18, delete “position,” and insert -- position; --, therefor.

In column 14, line 21, in Claim 22, delete “rotation” and insert -- rotating --, therefor.

Signed and Sealed this

Twenty-fourth Day of February, 2009

JOHN DOLL
*Acting Director of the United States Patent and Trademark Office*